US008205968B2

(12) United States Patent
Nakagawa et al.

(10) Patent No.: US 8,205,968 B2
(45) Date of Patent: Jun. 26, 2012

(54) LIQUID DISCHARGE HEAD AND LIQUID DISCHARGE METHOD

(75) Inventors: Yoshiyuki Nakagawa, Kawasaki (JP); Ken Tsuchii, Sagamihara (JP); Masataka Sakurai, Kawasaki (JP); Tomoyuki Inoue, Tokyo (JP); Akiko Saito, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 318 days.

(21) Appl. No.: 12/619,572

(22) Filed: Nov. 16, 2009

(65) Prior Publication Data

US 2010/0123760 A1 May 20, 2010

(30) Foreign Application Priority Data

Nov. 18, 2008 (JP) ..... 2008-294590

(51) Int. Cl.
*B41J 2/05* (2006.01)

(52) U.S. Cl. ..... 347/65

(58) Field of Classification Search ..... 347/54, 347/56, 65

See application file for complete search history.

(56) References Cited

U.S. PATENT DOCUMENTS

| | | | | |
|---|---|---|---|---|
| 6,568,799 | B1 | 5/2003 | Yang et al. | |
| 6,698,868 | B2 * | 3/2004 | Trueba et al. | 347/65 |
| 2003/0081072 | A1 | 5/2003 | Trueba | |
| 2008/0158304 | A1 | 7/2008 | Eto | |

FOREIGN PATENT DOCUMENTS

| | | |
|---|---|---|
| JP | 7-164640 | 6/1995 |
| JP | 2006-088493 | 4/2006 |
| WO | 01/49493 | 7/2001 |
| WO | 2007/149235 | 12/2007 |

* cited by examiner

*Primary Examiner* — An Do
(74) *Attorney, Agent, or Firm* — Canon USA Inc IP Division

(57) ABSTRACT

A liquid discharge head includes: a discharge port from which a liquid is discharged; a channel that communicates with the discharge port; and an energy generating element that is provided in the channel and generates energy used to discharge the liquid from the discharge port, wherein the channel includes a first inlet path supplying the liquid to the energy generating element; a second inlet path supplying the liquid to the energy generating element from a direction opposite to a direction in which the first inlet path supplies the liquid; and a outlet path allowing the liquid supplied to the energy generating element to run out.

8 Claims, 7 Drawing Sheets

LIQUID DISCHARGE HEAD AND LIQUID DISCHARGE METHOD

BACKGROUND OF THE INVENTION

1. Field of the Invention

The present invention relates to a liquid discharge head. More specifically, the present invention relates to a liquid discharge head that discharges a liquid supplied from a flow path through which ink circulates, to print out an image.

2. Description of the Related Art

It is known that the following problems arise in discharging a liquid from a liquid discharge head, when ink thickening occurs near a discharge port, if quiescent time in which no image is printed out is longer than predetermined time.

(1) Color unevenness of the image due to a change in a discharge amount.

(2) Deterioration in impact precision due to a change in discharge velocity.

(3) Non-discharge in which the ink is not discharged. Causes of these problems are that a meniscus surface of the ink present near the discharge port contacts external air, and volatile components contained in the ink evaporate, resulting in the ink thickening.

In particular, if the quiescent time is long, then viscosity conspicuously increases and solid components of the ink adheres to an area in the neighborhood of the discharge port. The solid components increase a liquid resistance of the ink. If the viscosity further increases, discharge failure occurs.

As one of measures against such an ink thickening phenomenon, a method is known for causing ink supplied to a recording head to circulate through a circulation path as discussed in Japanese Patent Application Laid-Open No. 2006-88493. The ink is introduced into the discharge port from an upstream part of the circulation path, the introduced ink flows to a downstream part of the circulation path, and the ink is discharged while the ink is circulating. The following technique is also known as discussed in Japanese Patent Application Laid-Open No. 7-164640. According to the technique, common liquid chambers independent of each other are provided for supplying ink from two directions, and a pressure difference is generated between the common liquid chambers, thereby generating a circulatory flow.

However, the inventor discovered that these conventional techniques have the following problems if the ink is discharged during circulation.

With a configuration of each of the conventional techniques, if the ink is discharged during the circulation, then a discharge direction is inclined to change an impact position and image degradation often occurs. Furthermore, even if a main drop discharged from the liquid discharge head impacts on a predetermined position without receiving the influence of the circulation, a discharge direction of sub drops (satellite drops) accompanying the main drop is inclined and impact positions of the satellite drops often change.

The reason for this phenomenon will be described with reference to FIGS. 3A to 3D. In FIGS. 3A to 3D, a liquid flow path 11 is formed to be symmetric about a discharge port 12 and an energy generating element 13. Since a circulatory flow 14 in the liquid flow path 11 is a one-directional flow, this circulatory flow 14 is asymmetric about the discharge port 12. Accordingly, a pressure difference is generated between an upstream side into which the circulatory flow 14 is introduced and a downstream side from which the circulatory flow 14 is discharged, near the discharge port 12. As a result, a meniscus surface 17 formed on the discharge port 12 is asymmetric between the upstream side and the downstream side, a discharge direction is inclined, and an impact position changes (see FIGS. 3C and 3D). This influences an image to be printed out.

SUMMARY OF THE INVENTION

The present invention is directed to a liquid discharge head and a liquid discharge method that can reduce inclination of a discharge direction and thus can reduce a change in an impact position even when ink is being discharged while circulating.

According to an aspect of the present invention, a liquid discharge head includes: a discharge port from which a liquid is discharged; a flow path that communicates with the discharge port; and an energy generating element that is provided in the flow path and generates energy used to discharge the liquid from the discharge port, wherein the flow path includes a first inlet path supplying the liquid to the energy generating element; a second inlet path supplying the liquid to the energy generating element from a direction opposite to a direction in which the first inlet flow path supplies the liquid; and a outlet path allowing the liquid supplied to the energy generating element to run out.

According to the present invention, it is possible to reduce inclination of a discharge direction and reduce a change in an impact position when the ink is being discharged while circulating. Thus, a high-quality image can be obtained.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to describe the principles of the invention.

DESCRIPTION OF THE EMBODIMENTS

Various exemplary embodiments, features, and aspects of the invention will be described in detail below with reference to the drawings.

The present invention will be described taking an inkjet recording method or system as an example to which the present invention is applied. However, the application of the present invention is not limited to the inkjet recording method or system but applicable to biochip production, printing of an electronic circuit or the like.

A liquid discharge head can be mounted on such a device as a printer, a copying machine, a facsimile including a communication system, or a word processor including a printer unit, or on an industrial recording device combined with various types of processing devices in a multiple manner to provide multifunction. For example, the liquid discharge head can be used to produce a biochip, to print an electronic circuit or to discharge an atomized medication.

By using this liquid discharge head for recording purpose, for example, an image can be recorded on various types of recording mediums such as paper, thread, fiber, cloth, leather, metal, plastic, glass, wood, and ceramics.

"Recording" used in the specification of the present invention refers to not only applying an image having a meaning such as a character or a graphic onto a recording medium but also applying an image having no meaning such as a pattern on the recording medium.

Furthermore, since exemplary embodiments to be described below are appropriate and specific examples of the present invention, various restrictions that are technically preferable are imposed on the exemplary embodiments. However, exemplary embodiments are not limited to those described in the specification of the present invention and other specific methods as long as the exemplary embodiments comply with the concept of the present invention.

Figure 1A:
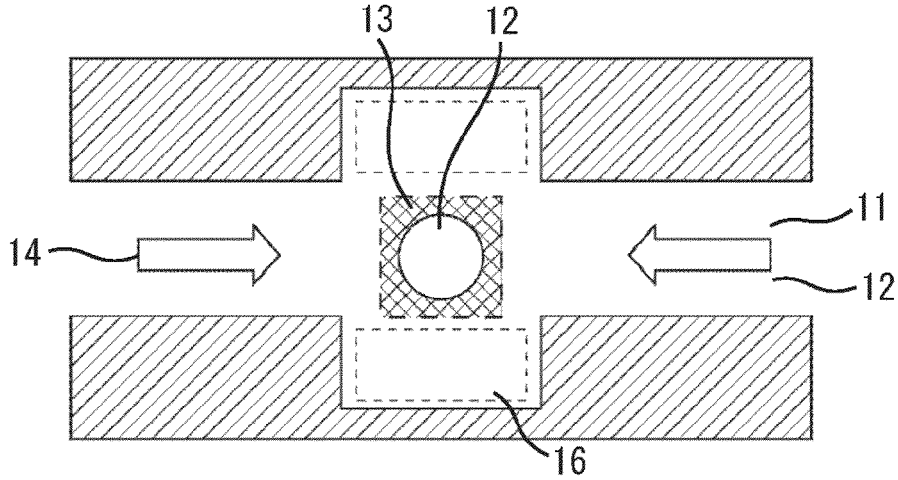
FIGS. 1A to 1D are pattern diagrams illustrating a configuration of a first exemplary embodiment of the present invention.
Figure 1B:
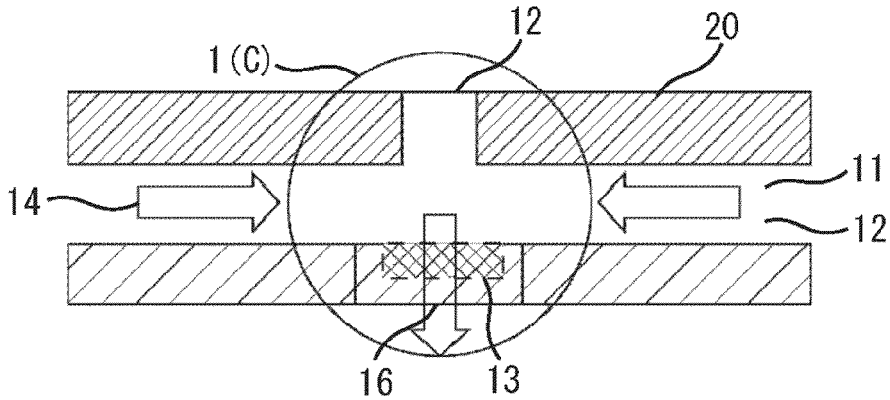
Figure 1C:
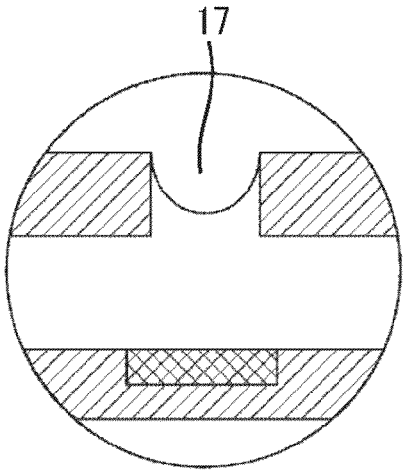
Figure 1D:
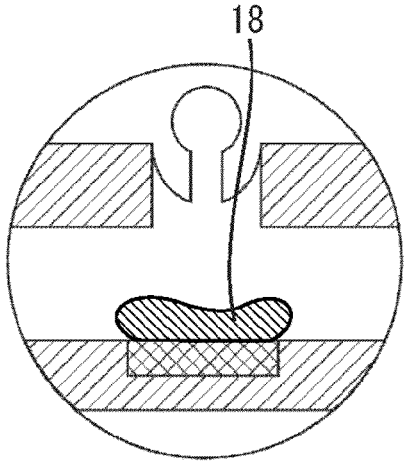
Figure 2A:
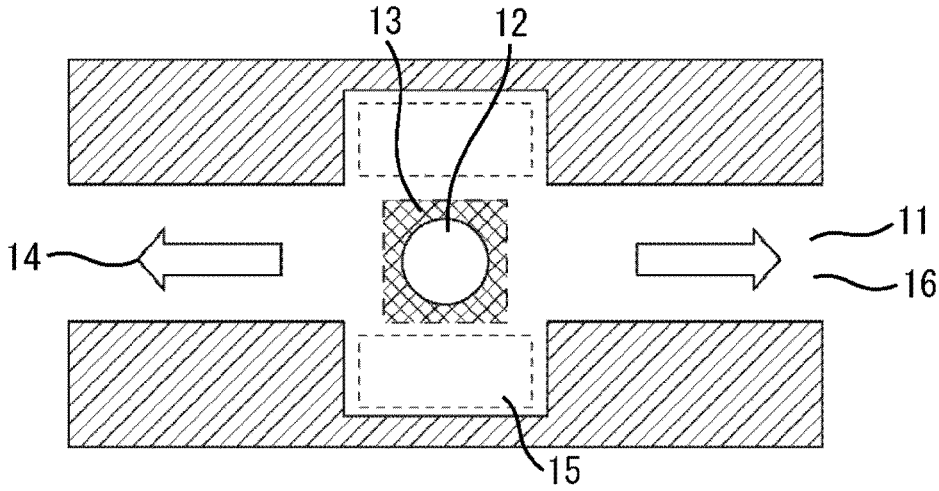
FIGS. 2A to 2D are pattern diagrams illustrating the configuration of the first exemplary embodiment of the present invention.
Figure 2B:
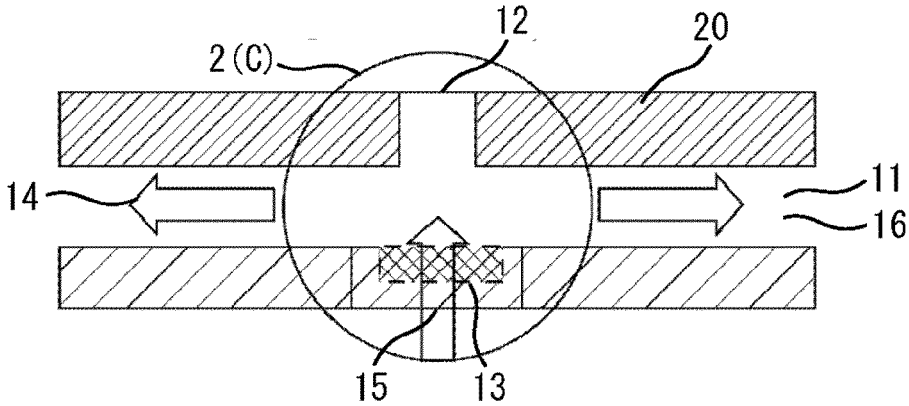
Figure 2C:
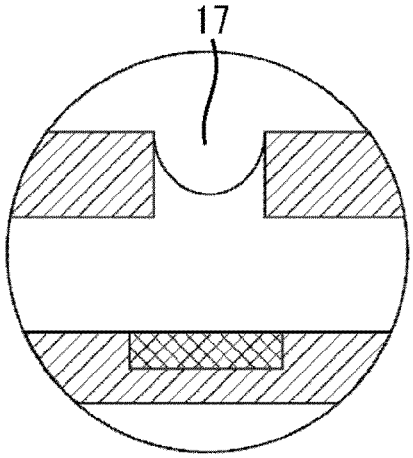
Figure 2D:
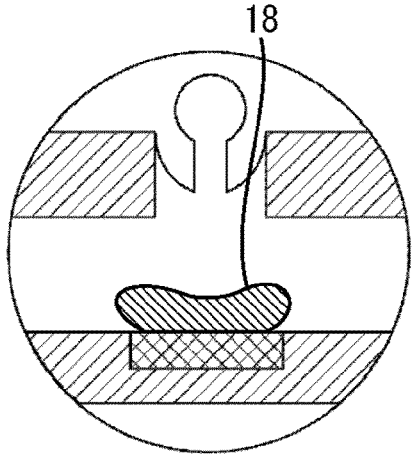
Figure 3A:
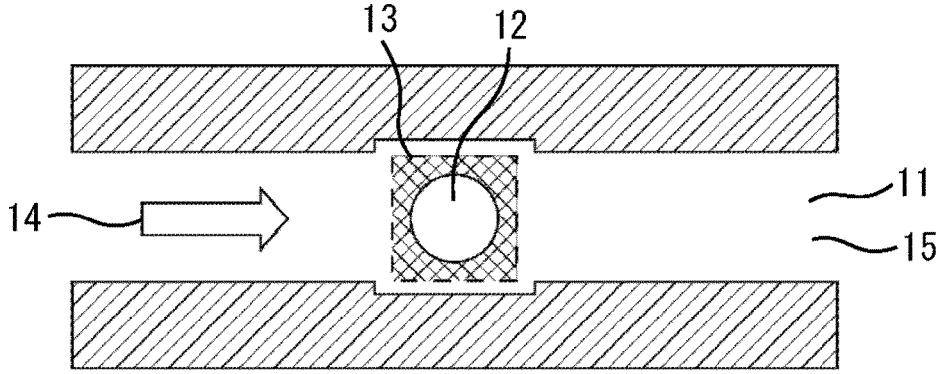
FIGS. 3A to 3D are pattern diagrams illustrating problems that the present invention is to solve.
Figure 3B:
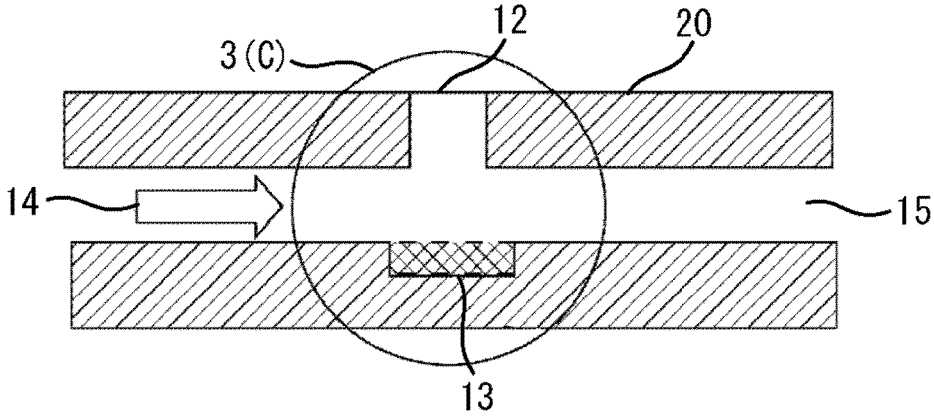
Figure 3C:
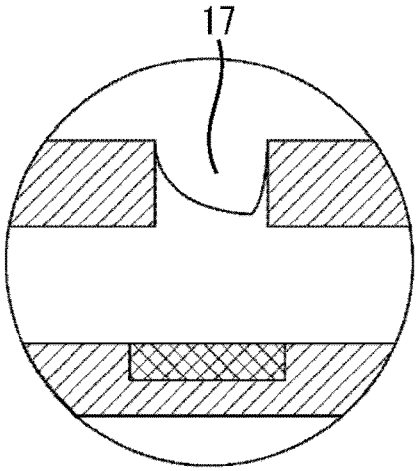
Figure 3D:
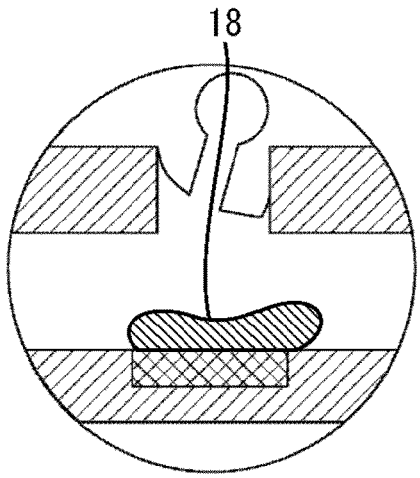

One exemplary embodiment of the present invention will be described below with reference to FIGS. 1A to 1D and 2A to 2D. FIGS. 1A and 1B are a cross-sectional view and a longitudinal sectional view, typically illustrating neighborhood areas of a liquid flow path 11 of a liquid discharge head that includes the liquid flow path 11, a discharge port 12, an energy generating element 13 that generates energy used to discharge liquid, and a circulatory flow 14. FIGS. 1C and 1D are enlarged views of a part 1C shown in FIG. 1B.

In FIG. 1A, a recording head includes the liquid flow path 11 in which the liquid such as ink flows, the discharge port 12 communicating with the liquid flow path 11 and formed in an orifice plate 20, and the energy generating element 13 applying discharge energy to the ink in the liquid flow path 11. The liquid flow path 11 forms a part of an ink circulation path. The circulatory flow 14 of the ink occurs in the liquid flow path 11. An inlet path 15, into which the ink is introduced, is formed in parallel to a substrate 19, and provided to the energy generating element 13. In addition, an outlet path 16, from which the ink is discharged, is formed as a through-hole penetrating through the substrate 19. The inlet path 15 includes a first inlet path in which the ink flows from the left to the energy generating element 13, and a second inlet path in which the ink flows from a direction opposite to the first inlet path, to the energy generating element 13. In the present exemplary embodiment, a plurality of inlet paths 15 and a plurality of outlet paths 16 are arranged to be point symmetric about the discharge port 12.

Referring next to FIG. 1C, in a stationary state, a meniscus surface 17 is formed on the discharge port 12. The ink is discharged from the discharge port 12 by driving the energy generating element 13 (i.e., an electrothermal conversion element) in the stationary state and generating a bubble 18 in the ink.

Referring to FIGS. 1A and 1B, two liquid flow paths 11 are formed in a horizontal direction to the substrate 19, to be point symmetric about the discharge port 12. The liquid flow paths 11 also serve as the inlet paths 15 of the circulatory ink. The energy generating element 13 is formed at a position opposing the discharge port 12. Two outlet paths 16 of the ink penetrating through a front surface and a rear surface of the substrate 19 are present on both sides of the energy generating element 13 to be point symmetric about the discharge port 12. If pressure of the outlet paths 16 is reduced by driving a pump or the like (not shown) arranged, for example, outside of the liquid discharge head, the circulatory flow 14 of the ink introduced from the inlet path 15 flows right under the discharge port 12. The circulatory flow 14 of the ink flowing right under the discharge port 12 runs out from each outlet path 16 to outside of the liquid discharge head.

In FIGS. 1A to 1D, the circulatory flow 14 of the introduced ink is point symmetric about the discharge port 12. Therefore, as shown in FIG. 1C, the meniscus surface 17 formed on the discharge port 12 is almost point symmetric about the discharge port 12 even while the ink is circulating.

The present exemplary embodiment has the following advantages since the circulatory flow 14 is point symmetric about the discharge port 12. Almost no pressure difference is generated among a plurality of liquid flow paths formed for the discharge port 12. Accordingly, as shown in FIG. 1C, the meniscus surface 17 formed on the discharge port 12 is substantially point symmetric about the discharge port 12. Moreover, if the energy generating element 13 is the electrothermal conversion element, the bubble 18 formed in the ink is substantially point symmetric about the discharge port 12. As a result, if the energy generating element 13 applies energy to the ink and the ink is discharged from the discharge port 12, inclination of the discharge direction is reduced and a change in an impact position is reduced.

On the other hand, in the present exemplary embodiment, the ink is discharged from the discharge port 12 by driving the energy generating element 13 in a state in which the ink circulates in the liquid flow paths 11. If the circulatory flow 14 constantly occurs and acts on the discharge port 14, the present exemplary embodiment shows the following advantages.

First, not only action of a capillary force of the meniscus surface 17 near the discharge port 12 but also introduction of the circulatory flow 14 into the discharge port 12 can increase ink supply capability. This accelerates refilling of the ink to the energy generating element 13 after discharge of the ink, resulting in an increase in refill frequency.

Second, since the circulatory flow 14 is introduced into the discharge port 12, liquid resistance of the liquid flow paths 11 present in rear of the energy generating element 13 increases in an ink flow direction. Accordingly, pressure generated by the energy generating element 13 is propagated to the discharge port 12 more efficiently, thereby improving discharge efficiency.

Moreover, the circulatory flow 14 can advantageously discharge the bubble 18 generated in or invading the liquid discharge head, to the outside of the liquid discharge head, reduce a temperature rise caused by heat generated in the energy generating element 13 serving as the electrothermal conversion element, and reduce the ink thickening.

Figure 7A:
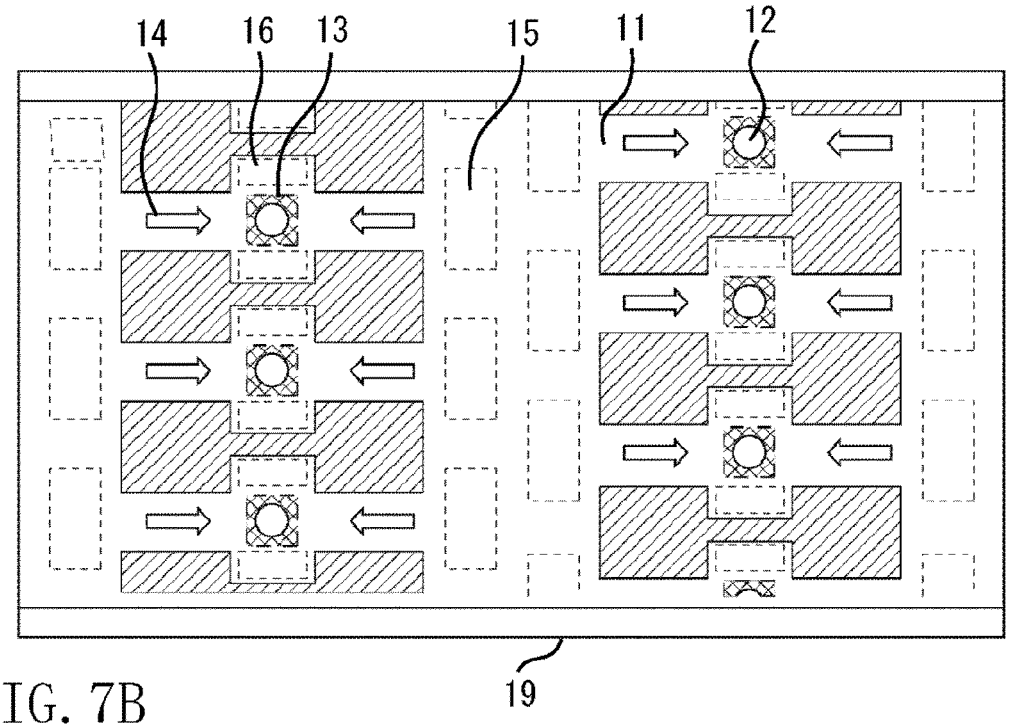
FIGS. 7A and 7B are pattern diagrams illustrating the configuration of the first exemplary embodiment of the present invention.
Figure 7B:
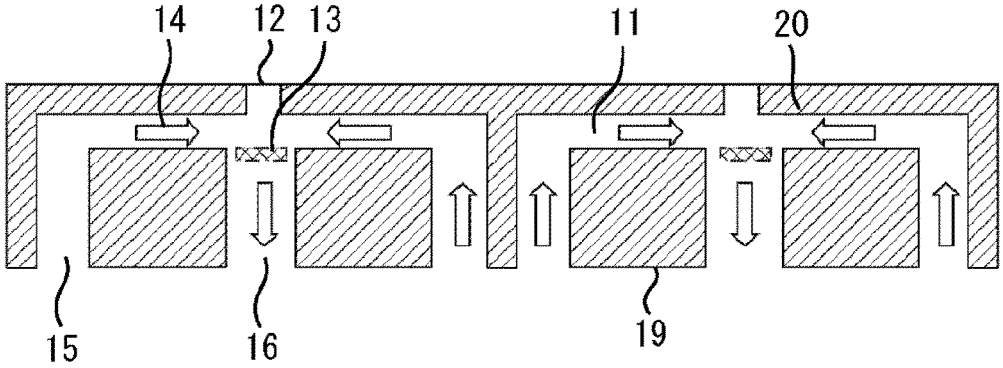

Next, a recording head in which a plurality of discharge ports 12 and the like are formed will be described with reference to FIGS. 7A and 7B. FIGS. 7A and 7B are a cross-sectional view and a longitudinal sectional view illustrating the typical recording head using the configuration shown in FIGS. 1A to 1D.

The liquid flow paths 11 communicate the inlet paths 15 introducing the ink into the energy generating elements 13 with the outlet paths 16 from which the ink is discharged, and also communicate the inlet paths 15 with the discharge ports 12. The inlet paths 15 formed by holes penetrating the front surface and the rear surface of the substrate 19 are arranged on both sides of each liquid flow path 11 independently of one another. The outlet paths 16 formed by holes penetrating the front surface and the rear surface of the substrate 19 are arranged within each liquid flow path 11. In the present exemplary embodiment, two outlet paths 16 are formed to be point symmetric about one discharge port 12 and arranged in a direction crossing the inlet paths 15. Each of the energy generating elements 13 is arranged at a position opposing one discharge port 12.

A configuration shown in FIGS. 7A and 7B can introduce the circulatory flow 14 from the inlet paths 15 to pass through the liquid flow paths 11, introduce the flow 14 into the energy generating elements 13 right under the discharge ports 12, and discharge the flow 14 from the outlet paths 16.

In the present exemplary embodiment, the direction of the flow of the ink is not limited to that described above. More specifically, as shown in the drawings, the present invention is also applicable to the ink which flows in an opposite direction.

In FIGS. 2A to 2D, the inlet path 15 and the outlet path 16 are arranged differently from FIGS. 1A to 1D. As a result, the direction of the circulatory flow 14 is opposite to that shown in FIGS. 1A to 1D. However, in the configuration shown in FIGS. 2A to 2D, the circulatory flow 14 is also point symmetric about the discharge port 12 similarly to the configuration shown in FIGS. 1A to 1D. Accordingly, similarly to the configuration shown in FIGS. 1A to 1D, it is possible as its effect to reduce the inclination of the discharge direction and to reduce the change in the impact position even in the configuration shown in FIGS. 2A to 2D. Furthermore, similarly to the configuration shown in FIGS. 1A to 1D, the circulatory flow 14 shown in FIGS. 2A to 2D can as its effect discharge the bubble 18 generated in or invading the liquid discharge head, to the outside of the liquid discharge head, reduce a temperature rise caused by heat generated in the energy generating element 13 serving as the electrothermal conversion element, and reduce the ink thickening.

A liquid discharge head according to a second exemplary embodiment of the present invention will be described with reference to FIGS. 4A and 4B.

Figure 4A:
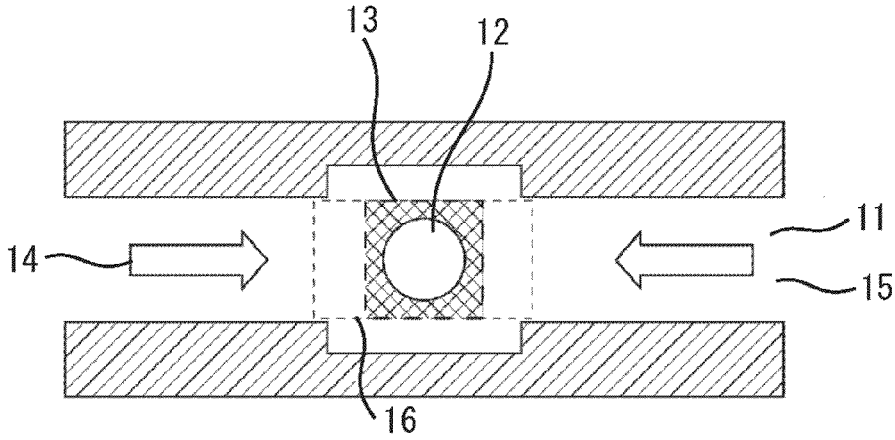
FIGS. 4A and 4B are pattern diagrams illustrating a configuration of a second exemplary embodiment of the present invention.
Figure 4B:
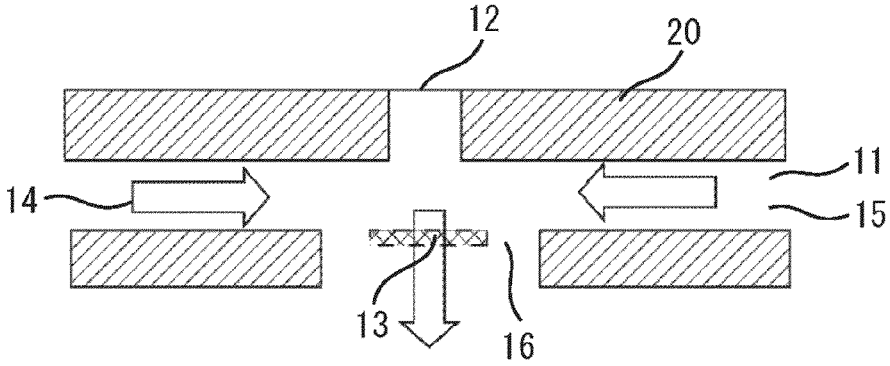

Similarly to FIGS. 1A to 1D and 2A to 2D according to the first exemplary embodiment, a circulatory flow 14 flows in and out of a discharge port 12 in FIGS. 4A and 4B, which shows a configuration of the liquid discharge head according to the second exemplary embodiment.

The present exemplary embodiment differs from the first exemplary embodiment in that an energy generating element 13 is a thin film element and both a front surface and a rear surface of the energy generating element 13 contact ink. With the configuration shown in FIGS. 4A and 4B, not only inclination of a discharge direction and a change of an impact position can be reduced, but also density of a nozzle can be increased.

A liquid discharge head according to a third exemplary embodiment of the present invention will be described with reference to FIGS. 5A and 5B.

A configuration of the third exemplary embodiment differs from the first and second exemplary embodiments in a configuration of an energy generating element 13 and in that the number of outlet paths 16 is one.

In the present exemplary embodiment, the liquid discharge head is a so-called back-shooter head in which energy generating elements 13 are formed on a rear surface of a substrate on which a discharge port 12 is formed. Two energy generating elements 13 are arranged to be point symmetric about the discharge port 12. Further, one outlet path 16 is formed at a position opposing the discharge port 12.

Figure 5A:
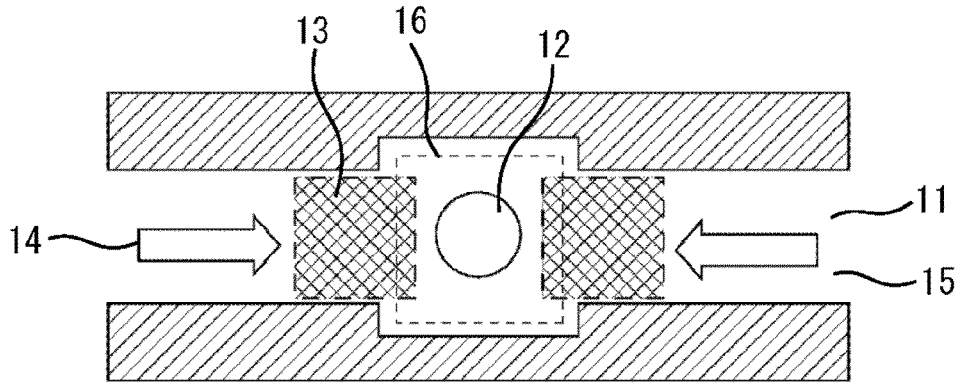
FIGS. 5A and 5B are pattern diagrams illustrating a configuration of a third exemplary embodiment of the present invention.
Figure 5B:
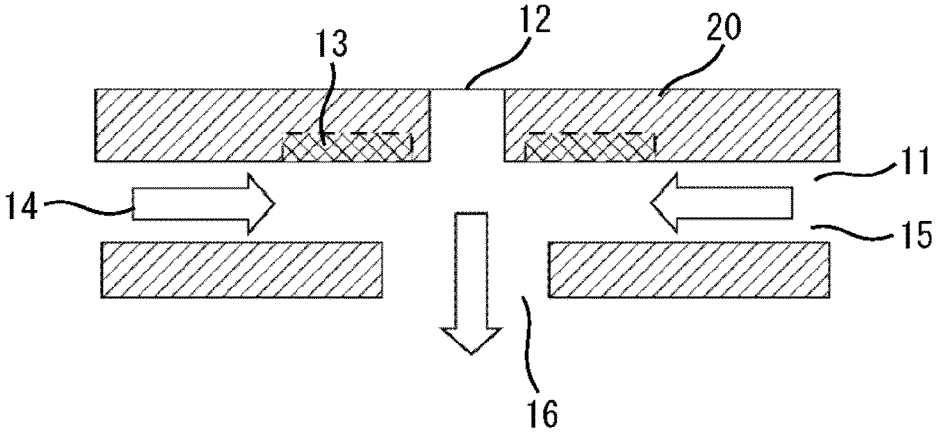

With the configuration shown in FIGS. 5A and 5B, not only inclination of a discharge direction and a change of an impact position can be reduced but also density of a nozzle can be increased. With the configuration shown in FIGS. 5A and 5B, as its effect, stagnation of a circulatory flow 14 is not easily generated since the outlet path 16 is arranged on extension of inlet paths 15.

Figure 6A:
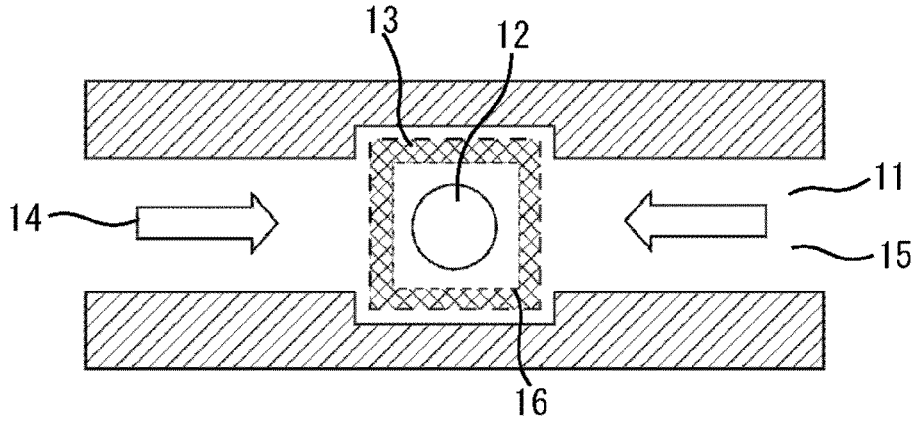
FIGS. 6A and 6B are pattern diagrams illustrating a configuration of a fourth exemplary embodiment of the present invention.
Figure 6B:
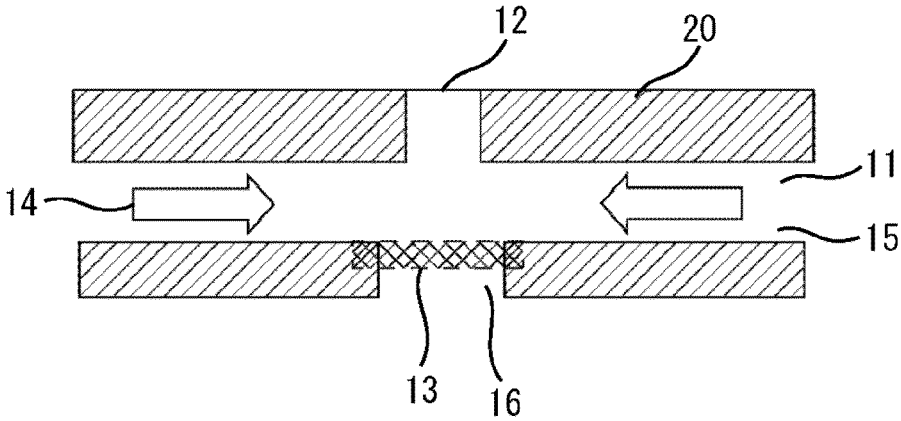

A liquid discharge head according to a fourth exemplary embodiment of the present invention will be described with reference to FIGS. 6A and 6B.

A configuration of the fourth exemplary embodiment differs from the first to third exemplary embodiments in that an energy generating element 13 is formed at a position opposing a discharge port 12 and in that an outlet path 16 is formed on the energy generating element 13. With the configuration shown in FIGS. 6A and 6B, not only inclination of a discharge direction and a change of an impact position can be reduced but also density of a nozzle can be increased. With the configuration shown in FIGS. 6A and 6B, as its effect, stagnation of a circulatory flow 14 is not easily generated since the outlet path 16 is arranged on extension of inlet paths 15.

The exemplary embodiments of the present invention have been described so far. The present invention is also applicable to appropriate combinations of the configurations of the exemplary embodiments.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2008-294590 filed Nov. 18, 2008, which is hereby incorporated by reference herein in its entirety.

What is claimed is:

1. A liquid discharge head comprising:

an orifice plate forming a discharge port configured to discharge a liquid;

a substrate;

a flow path configured by the orifice plate and the substrate, the flow path being configured to communicate with the discharge port;

an energy generating element provided on the substrate, the energy generating element being configured to generate energy which is used to discharge the liquid from the discharge port; and a first inlet opening, a second inlet opening and a first outlet opening, each formed in the substrate as through-holes, wherein the flow path includes:

a first inlet path supplying the liquid from the first inlet opening to the energy generating element;

a second inlet path supplying the liquid from the second inlet opening to the energy generating element from a direction opposite to a direction in which the first inlet path supplies the liquid; and an outlet path allowing the liquid supplied to the energy generating element to run out through the first outlet opening.

2. The liquid discharge head according to claim 1, wherein the flow path forms a part of a circulatory path providing a circulatory flow through which the liquid discharged from the outlet path is supplied to the energy generating element via the first and second inlet paths.

3. The liquid discharge head according to claim 1, wherein a plurality of the outlet paths is formed on the both sides of the energy generating element in a direction crossing the plurality of the inlet paths.

4. The liquid discharge head according to claim 1, wherein the outlet path is arranged opposing the discharge port.

5. The liquid discharge head according to claim 4, wherein the energy generating element is formed on an orifice plate forming the discharge port.

6. The liquid discharge head according to claim 1, wherein the energy generating element is a thin film element, and both a front surface and a rear surface of the thin film element contact the ink.

7. The liquid discharge head according to claim 1, wherein the first and second inlet paths are formed by the through-hole, and a plurality of the outlet paths is formed on the both sides of the energy generating element along a surface of the substrate.

8. A liquid discharge method for recording by a liquid discharge head including an orifice plate forming a discharge port configured to discharge a liquid; a substrate; a flow path formed by the orifice plate and the substrate, the flow path being configured to communicate with the discharge port; an energy generating element provided on the substrate, the energy generating element being configured to generate energy which is used to discharge the liquid from the discharge port; and a first inlet opening, a second inlet opening and a first outlet opening, each formed in the substrate as through-holes, the method comprising:

discharging the liquid by driving the energy generating element in a state where a circulatory flow is generated in which the liquid discharged from the outlet path is supplied to the energy generating element via the inlet paths, using the liquid discharge head including a first inlet path supplying the liquid from the first inlet opening to the energy generating element; a second inlet path supplying the liquid from the second inlet opening to the energy generating element from a direction opposite to a direction in which the first inlet path supplies the liquid; and a outlet path allowing the liquid supplied to the energy generating element to run out through the first outlet opening.

* * * * *